US010173807B1

(12) United States Patent
Liang et al.

(10) Patent No.: US 10,173,807 B1
(45) Date of Patent: Jan. 8, 2019

(54) ANTI-DUMPLING PALLET STRUCTURE

(71) Applicant: Wistron Corporation, New Taipei (TW)

(72) Inventors: Xiayan Liang, New Taipei (CN); Yunqiang Huang, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

(21) Appl. No.: 15/854,791

(22) Filed: Dec. 27, 2017

(30) Foreign Application Priority Data

Oct. 19, 2017 (CN) ..... 2017 1 0979345

(51) Int. Cl.
*B65D 19/38* (2006.01)

(52) U.S. Cl.
CPC ..... *B65D 19/38* (2013.01); *B65D 2519/0091* (2013.01)

(58) Field of Classification Search
CPC ..... B65D 19/38; B65D 2519/00; B65D 2519/0091
USPC ..... 108/54.1, 57.12, 56.3, 53.1
See application file for complete search history.

(56) References Cited

U.S. PATENT DOCUMENTS 1,747,352 A * 2/1930 Devine, Jr. ..... E01F 1/005 108/57.12
1,820,281 A * 8/1931 Leslie ..... B61D 45/008 108/57.12
3,176,632 A * 4/1965 Yingling ..... B65D 19/42 108/54.1
3,208,606 A * 9/1965 Epstein ..... B65D 85/62 108/54.1
3,888,368 A * 6/1975 Hawkins ..... B66C 23/44 108/54.1
4,012,021 A * 3/1977 Duceppe ..... H02K 5/26 248/651
4,061,086 A * 12/1977 Preuss ..... B65H 31/32 101/240
4,955,873 A * 9/1990 Rajlevsky ..... A61M 1/0001 128/DIG. 24
5,020,768 A * 6/1991 Hardt ..... F16M 11/22 248/188

(Continued)

FOREIGN PATENT DOCUMENTS

TW 231624 10/1994
TW I437968 B 5/2014
TW M547528 U 8/2017

*Primary Examiner* — Jose V Chen
(74) *Attorney, Agent, or Firm* — Winston Hsu

(57) ABSTRACT

An anti-dumpling pallet structure includes a pallet body and at least one supporting module. At least one chamber is formed inside the pallet body. The at least one supporting module includes a first supporting member and a second supporting member. The first supporting member and the second supporting member are movably connected to the pallet body. The first supporting member and the second supporting member protrude from the pallet body to provide support for preventing the pallet body acted by an external force from falling over when the at least one supporting module is located at a first position relative to the pallet body, and the first supporting member and the second supporting member are received inside the at least one chamber when the at least one supporting module is located at a second position relative to the pallet body.

20 Claims, 11 Drawing Sheets

(56) References Cited

U.S. PATENT DOCUMENTS

| | | | | |
|---|---|---|---|---|
| 5,601,541 | A * | 2/1997 | Swisher | A61M 1/0023 128/DIG. 24 |
| 6,311,941 | B1 * | 11/2001 | Feldmeyer | A47B 97/00 248/188.8 |
| 6,748,875 | B2 * | 6/2004 | Duley | F16M 5/00 108/54.1 |
| 7,114,694 | B2 * | 10/2006 | Li | F16M 11/18 248/677 |
| 7,252,350 | B2 * | 8/2007 | Chen | A47B 91/005 248/188.8 |
| 7,313,898 | B1 * | 1/2008 | Eller | B65B 21/06 108/153.1 |
| 7,909,074 | B2 * | 3/2011 | Yu | B23Q 1/0054 108/147 |
| 8,813,659 | B2 * | 8/2014 | Kuo | B65D 19/38 108/53.1 |
| 9,422,083 | B1 * | 8/2016 | Embleton | B65D 19/38 |

* cited by examiner

ANTI-DUMPLING PALLET STRUCTURE

BACKGROUND OF THE INVENTION

1. Field of the Invention

The present disclosure relates to a pallet structure, and more particularly to an anti-dumpling pallet structure capable of preventing a cargo from falling over.

2. Description of the Prior Art

A pallet structure is a common apparatus for supporting a cargo and allowing users to easily transport the cargo by a fork lift, a pallet truck, or other lifting equipment. However, when the cargo has an excessive height, a center of gravity of the cargo and the pallet structure is too high. At this moment, the cargo may fall over easily due to an external lateral force acting on the cargo. Furthermore, if the pallet structure is enlarged to increase stability, it not only reduces a loading space of a container, which increases transportation cost, but also causes damage to the cargo because the adjacent cargos may shake and collide with each other due to a gap between the adjacent cargos during transportation.

SUMMARY OF THE INVENTION

Therefore, it is an objective of the present disclosure to provide an anti-dumpling pallet structure capable of preventing a cargo from falling over for solving the aforementioned problems.

In order to achieve the aforementioned objective, the present disclosure discloses an anti-dumpling pallet structure including a pallet body and at least one supporting module. At least one chamber is formed inside the pallet body. The at least one supporting module is switchable between a first position and a second position relative to the pallet body. The at least one supporting module includes a first supporting member and a second supporting member. The first supporting member and the second supporting member are movably connected to the pallet body. The first supporting member and the second supporting member protrude from the pallet body to provide support for preventing the pallet body acted by an external force from falling over when the at least one supporting module is located at the first position relative to the pallet body, and the first supporting member and the second supporting member are received inside the at least one chamber when the at least one supporting module is located at the second position relative to the pallet body.

According to an embodiment of the present disclosure, the at least one supporting module further includes a sliding track disposed on the pallet body, and the first supporting member and the second supporting member are slidably disposed on the sliding track.

According to an embodiment of the present disclosure, the sliding track includes a first stopping portion and a second stopping portion, and the first stopping portion and the second stopping portion stop the first supporting member and the second supporting member respectively when the at least one supporting module is located at the first position relative to the pallet body.

According to an embodiment of the present disclosure, the at least one supporting module further includes a first pivoting member and a second pivoting member. The first supporting member is pivotally connected to the pallet body by the first pivoting member, and the second supporting member is pivotally connected to the pallet body by the second pivoting member.

According to an embodiment of the present disclosure, the first pivoting member and the second pivoting member are pivoting shafts.

According to an embodiment of the present disclosure, the first pivoting member and the second pivoting member are hinges.

According to an embodiment of the present disclosure, the first supporting member and the second supporting member are parallel to each other when the at least one supporting module is located at the first position relative to the pallet body.

According to an embodiment of the present disclosure, a sum of a length of the first supporting member and a length of the second supporting member is substantially equal to or less than a width of a lateral side of the pallet body.

According to an embodiment of the present disclosure, a length of the first supporting member and a length of the second supporting member are substantially equal to a half of a width of a lateral side of the pallet body.

According to an embodiment of the present disclosure, the first supporting member and the second supporting member are aligned on a line when the at least one supporting module is located at the first position relative to the pallet body.

According to an embodiment of the present disclosure, the first supporting member and the second supporting member are at least partially overlapped with each other and received inside the at least one chamber when the at least one supporting module is located at the second position relative to the pallet body, and the first supporting member and the second supporting member are parallel to each other when the at least one supporting module is located at the first position relative to the pallet body.

According to an embodiment of the present disclosure, a sum of a length of the first supporting member and a length of the second supporting member is substantially greater than a width of a lateral side of the pallet body.

According to an embodiment of the present disclosure, a length of the first supporting member and a length of the second supporting member are substantially equal to a width of a lateral side of the pallet body.

According to an embodiment of the present disclosure, the first supporting member and the second supporting member are not aligned on a line when the at least one supporting module is located at the first position relative to the pallet body.

According to an embodiment of the present disclosure, the pallet structure includes a first side, a second side, a third side, a fourth side, a fifth side and a sixth side. The first side is for supporting an object. The second side is opposite to the first side and for contacting a supporting surface. The third side and the fourth side are opposite to each other and adjacent to the first side and the second side. The fifth side and the sixth side are opposite to each other and adjacent to the first side, the second side, the third side and the fourth side. A length of the fifth side and a length of the sixth side are greater than a length of the third side and a length of the fourth side, and the at least one supporting module is disposed on at least one of the third side and the fourth side.

According to an embodiment of the present disclosure, the pallet structure includes two supporting modules disposed on the third side and the fourth side respectively.

According to an embodiment of the present disclosure, the first supporting member and the second supporting member protrude from the fifth side and the sixth side of the pallet body respectively when the at least one supporting module is located at the first position relative to the pallet body.

According to an embodiment of the present disclosure, the first supporting member and the second supporting member do not protrude from the fifth side and the sixth side of the pallet body respectively when the at least one supporting module is located at the second position relative to the pallet body.

According to an embodiment of the present disclosure, the first position is an unfolded position. The second position is a folded position. The first supporting member and the second supporting member are received inside the at least one chamber and do not protrude from the pallet body when the at least one supporting module is located at the folded position relative to the pallet body.

According to an embodiment of the present disclosure, the pallet structure is adapted for carrying a cargo. A height of the cargo is substantially greater than or equal to a height of the pallet structure, and the cargo is a cabinet, a server rack, or a display device.

In summary, in the present disclosure, when the cargo is placed on the pallet structure and stored in a warehouse, the supporting module can be operated to unfold relative to the pallet body to the unfolded position, i.e., the first position, so that the first supporting member and the second supporting member protrude from the pallet body. At this moment, the first supporting member and the second supporting member can provide a greater resistant moment arm for generating a larger resistant moment against a moment caused by an external lateral force acting on the cargo. Therefore, the present disclosure can effectively prevent the cargo and the pallet structure from falling over. On the other hand, when the cargo and the pallet structure are loaded into a container for transportation, the supporting module can be operated to fold relative to the pallet body to the folded position, i.e., the second position, so that the first supporting member and the second supporting member are folded inside the chamber and does not protrude from the pallet body. At this moment, the cargo and the pallet structures can be closely arranged adjacent to other cargos and other pallet structures respectively. Therefore, it can effectively increase usage rate of a loading space of the container, which reduces transportation cost and prevents damage of the cargos caused by collision during transportation.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
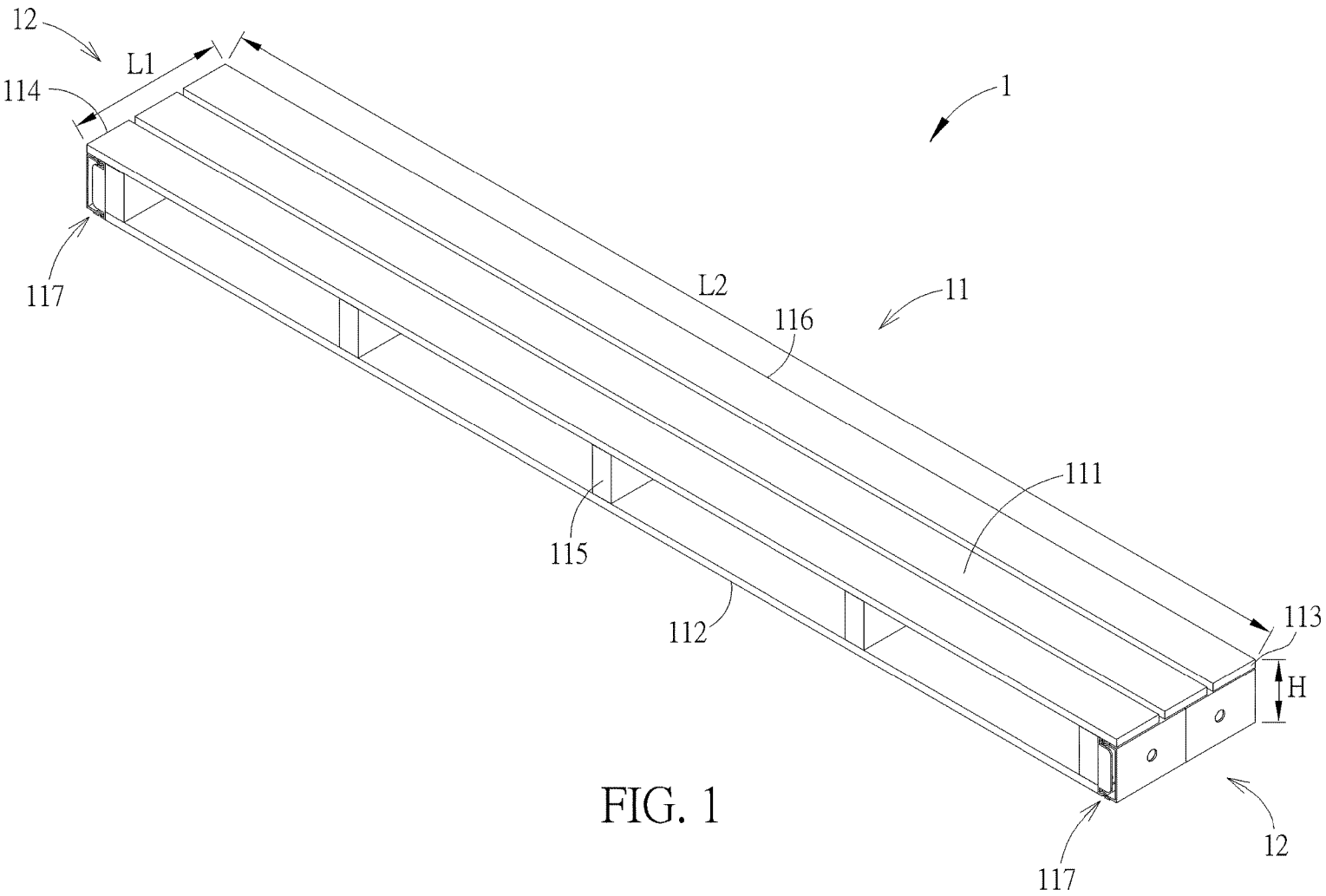
FIG. 1 and FIG. 2 are diagrams of a pallet structure indifferent states according to a first embodiment of the present disclosure.
Figure 2:
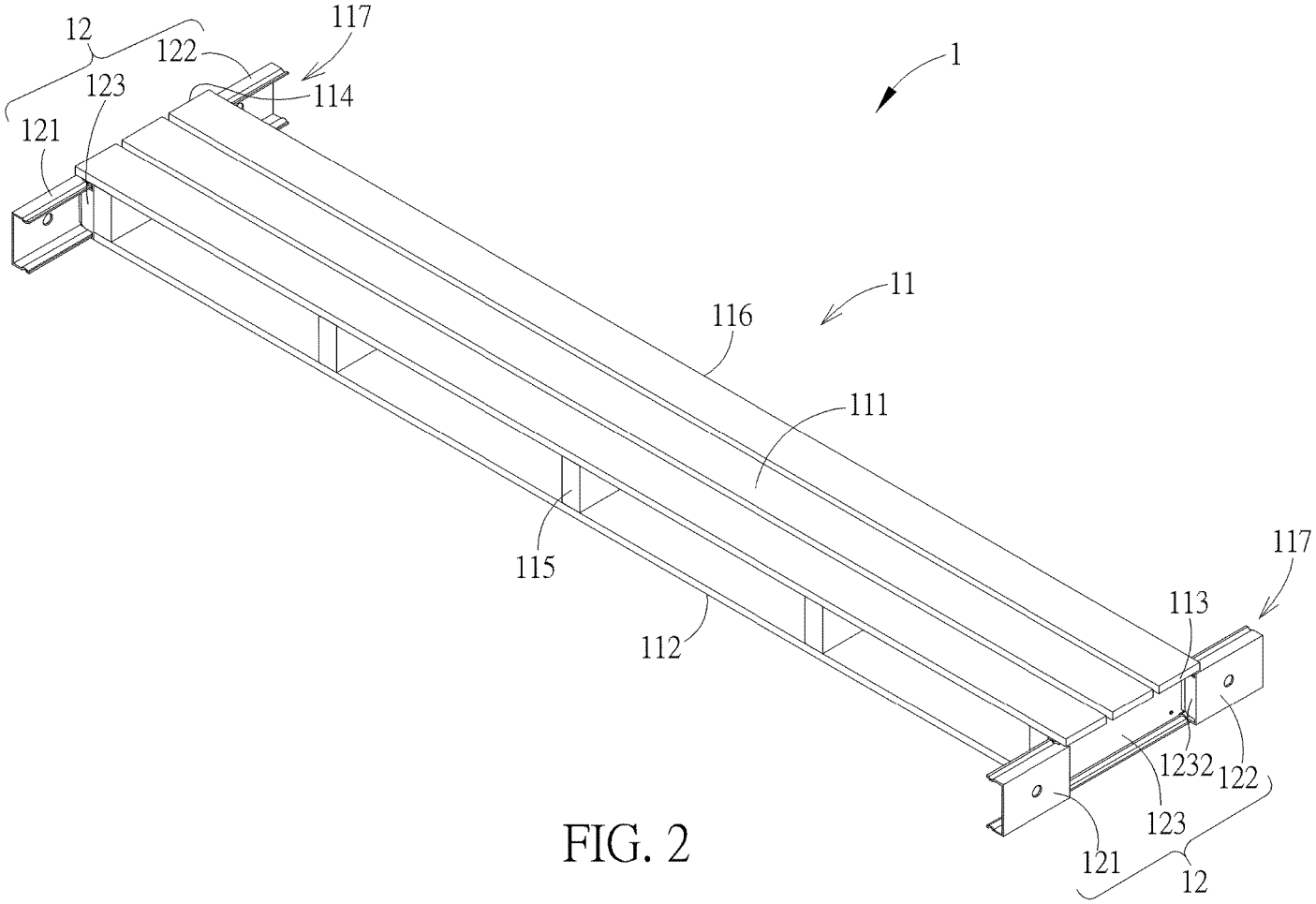
Figure 3:
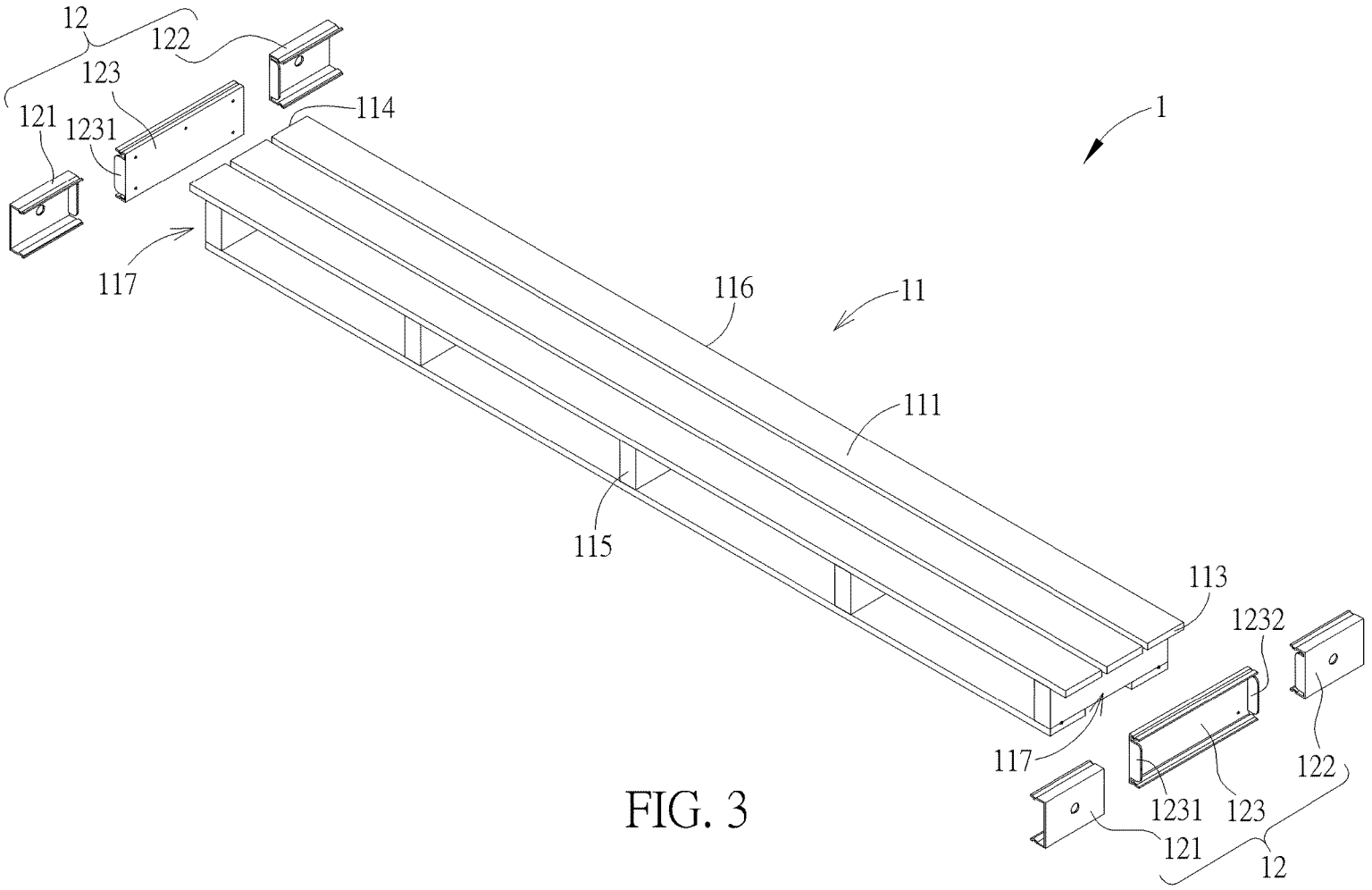
FIG. 3 is an exploded diagram of the pallet structure according to the first embodiment of the present disclosure.

Please refer to FIG. 1 to FIG. 3. FIG. 1 and FIG. 2 are diagrams of a pallet structure 1 in different states according to a first embodiment of the present disclosure. FIG. 3 is an exploded diagram of the pallet structure 1 according to the first embodiment of the present disclosure. As shown in FIG. 1 to FIG. 3, the pallet structure 1 includes a pallet body 11 and two supporting modules 12. The pallet structure 1 can be preferably adapted to support a cargo, such as a cabinet, a server rack, a display device, or other large electronic device, which has a height greater than a height H of the pallet structure 1, for preventing damage of the cargo due to falling over. However, it is not limited thereto. The pallet structure 1 also can be adapted to support other cargos. In this embodiment, the pallet body 11 is substantially a flat cuboid. The pallet body 11 includes a first side 111, a second side 112, a third side 113, a fourth side 114, a fifth side 115 and a sixth side 116. The first side 111 is for supporting the cargo or other objects. The second side 112 is opposite to the first side 111 and for contacting a supporting surface or a ground surface. The third side 113 and the fourth side 114 are opposite to each other and adjacent to the first side 111 and the second side 112. The fifth side 115 and the sixth side 116 are opposite to each other and adjacent to the first side 111, the second side 112, the third side 113 and the fourth side 114. Lengths L2 of the fifth side 115 and the sixth side 116 are greater than lengths L1 of the third side 113 and the fourth side 114. A chamber 117 is formed inside each of the third side 113 and the fourth side 114. The two supporting modules 12 are disposed inside the two chambers 117 on the third side 113 and the fourth side 114 respectively and switchable between a first position and a second position. However, the numbers and the structure of the pallet structure 11 and the supporting module 12 are not limited to this embodiment. It depends on practical demands.

Each of the two supporting modules 12 includes a first supporting member 121, a second supporting member 122 and a sliding track 123. The two sliding tracks 123 are disposed on the third side 113 and the fourth side 114 respectively. The first supporting member 121 and the second supporting member 122 of each of the two supporting modules 12 are slidably disposed on the corresponding sliding track 123. When each supporting module 12 is unfolded relative to the pallet body 11 to an unfolded position, i.e., the first position, as shown in FIG. 2, the first supporting member 121 and the second supporting member 122 protrude from the fifth side 115 and the sixth side 116 of the pallet body 11 respectively. When each supporting module 12 is folded relative to the pallet body 11 to a folded position, i.e., the second position, as shown in FIG. 1, the first supporting member 121 and the second supporting member 122 do not protrude from the fifth side 115 and the sixth side 116 of the pallet body 11 respectively and are folded inside the chamber 117. In other words, in this embodiment, the first supporting member 121 and the second supporting member 122 can be foldable relative to the pallet body 11 in a slidable manner. The sliding track 123 includes a first stopping portion 1231 and a second stopping portion 1232. When each of the two supporting modules 12 is unfolded relative to the pallet body 11 to the unfolded position, the first stopping portion 1231 and the second stopping portion 1232 stop the first supporting member 121 and the second supporting member 122 respectively, so as to restrain sliding ranges of the first supporting member 121 and the second supporting member 122 and prevent the first supporting member 121 and the second supporting member 122 from disengaging from the sliding track 123.

Furthermore, in this embodiment, since the first supporting member 121 and the second supporting member 122 can be parallel to each other and aligned on a line, a length of the first supporting member 121 and a length of the second supporting member 122 can be preferably equal to or less than a half width of a lateral side, i.e., the third side 113 or the fourth side 114, of the pallet body 11, so that the first supporting member 121 and the second supporting member 122 do not protrude from the pallet body 11 when the supporting module 12 is located at the folded position, as shown in FIG. 1, relative to the pallet body 11. However, it is not limited thereto. As long as a sum of the length of the first supporting member 121 and the length of the second supporting member 122 is substantially equal to or less than the width of the lateral side of the pallet body 11, the first supporting member 121 and the second supporting member 122 can be disposed in a parallel manner and aligned on a line. However, the first supporting member and the second supporting of the present disclosure also can be not aligned on a line, and the length of the first supporting member 121 and the length of the second supporting member 122 can be greater than the half width of the lateral side, i.e., the third side 113 or the fourth side 114, of the pallet body 11, so that the first supporting member 121 and the second supporting member 122 are partially overlapped when the supporting module 12 is located at the folded position. It depends on practical demands.

Figure 4:
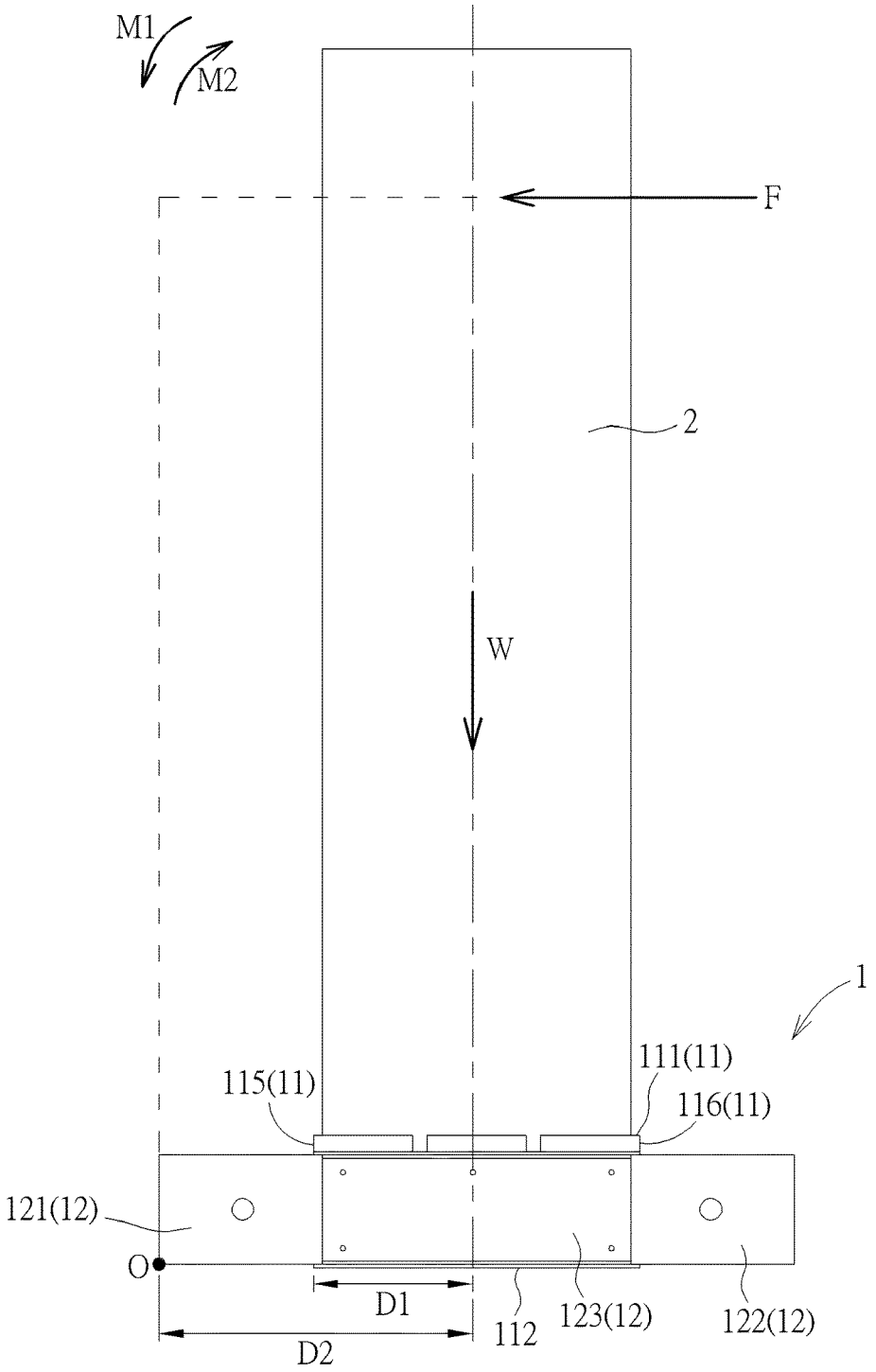
FIG. 4 is a free body diagram of the pallet structure according to the first embodiment of the present disclosure.

Please refer to FIG. 1 to FIG. 4. FIG. 4 is a free body diagram of the pallet structure 1 according to the first embodiment of the present disclosure. As shown in FIG. 2 and FIG. 4, when the cargo 2 is placed on the pallet structure 1 and stored in a warehouse, users can operate the supporting modules 12 to slide relative to the pallet body 11 to the unfolded positions, as shown in FIG. 1, so that the first supporting members 121 and the second supporting members 122 protrude from the fifth side 115 and the sixth side 116 respectively, so as to prevent the cargo 2 and the pallet structure 1 from falling over due to an external force. At this moment, since the first supporting member 121 and the second supporting member 122 extend an overall length of the pallet structure 1, a resistant moment arm D2 provided by the unfolded supporting module 12 is greater than a resistant moment arm D1 only provided by the third side 113 or the fourth side 114. Furthermore, when the length of the first supporting member 121 and the length of the second supporting member 122 is a half width of the third side 113 or the fourth side 114 of the pallet body 11, the resistant moment arm D2 is substantially twice as long as the resistance moment arm D1. Therefore, the first supporting member 121 and the second supporting member 122 can allow a weight W of the cargo 2 and the pallet structure 1 to generate a resistant moment M2 relative to a fulcrum O which is large enough to overcome a moment M1 relative to the fulcrum O generated by a lateral force F. In other words, when the resistant moment arm D2 is twice as long as the resistant moment arm D1, the resistant moment M2 generated by the weight W of the cargo 2 and the pallet structure 1 with the unfolded supporting module 12 is twice as large as the moment generated by the weight W of the cargo and the pallet structure 1 with the folded supporting module 12, which can prevent the cargo 2 and the pallet structure 1 from falling over effectively.

On the other hand, when the cargo 2 and the pallet structure 1 are loaded into a container for transportation, users can operate the two supporting modules 12 to slide relative to the pallet structure 11 to the folded positions, as shown in FIG. 1, so that the first supporting members 121 and the second supporting members 122 are folded inside the chambers 117 and do not protrude from the fifth side 115 and the sixth side 116 of the pallet body 11 respectively. At this moment, the cargo 2 and the pallet structure 1 can be arranged adjacent to other cargos and other pallet structures closely without any gap so as to prevent sway of the cargos. Therefore, it can effectively increase usage rate of a loading space of the container, which reduces transportation cost and prevents damage of the cargos caused by collision during transportation.

Figure 5:
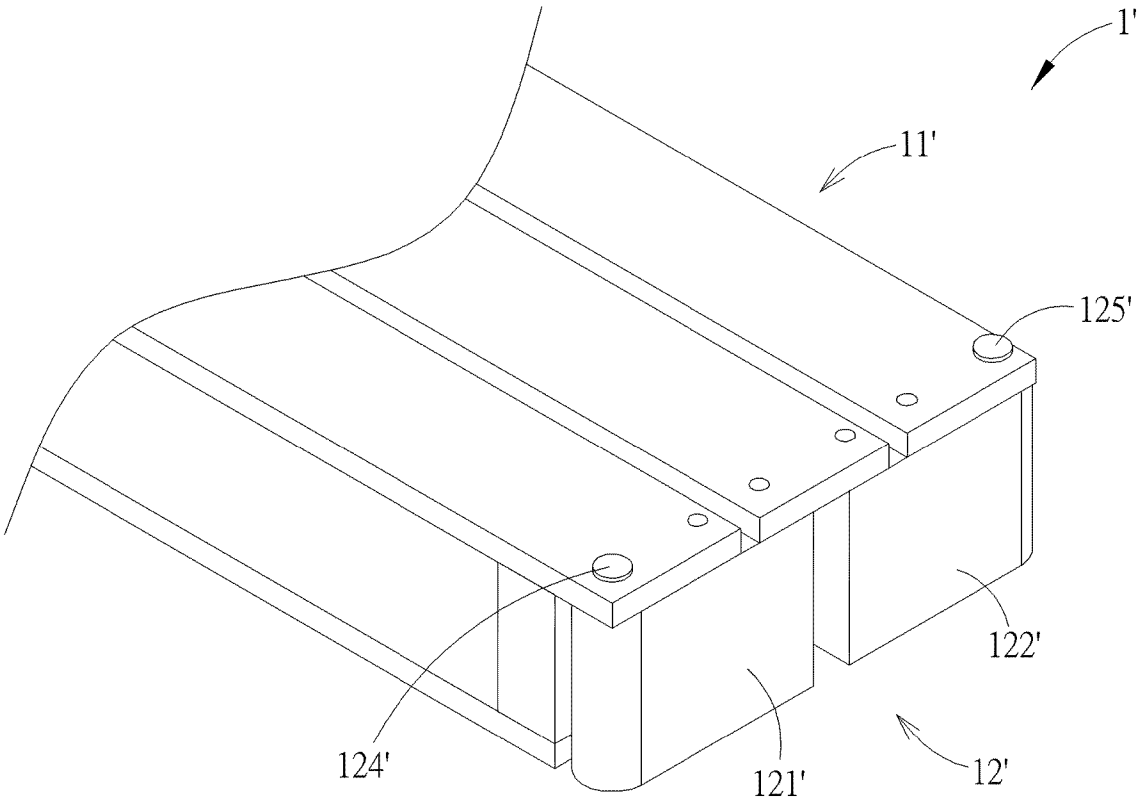
FIG. 5 and FIG. 6 are diagrams of a pallet structure in different states according to a second embodiment of the present disclosure.
Figure 6:
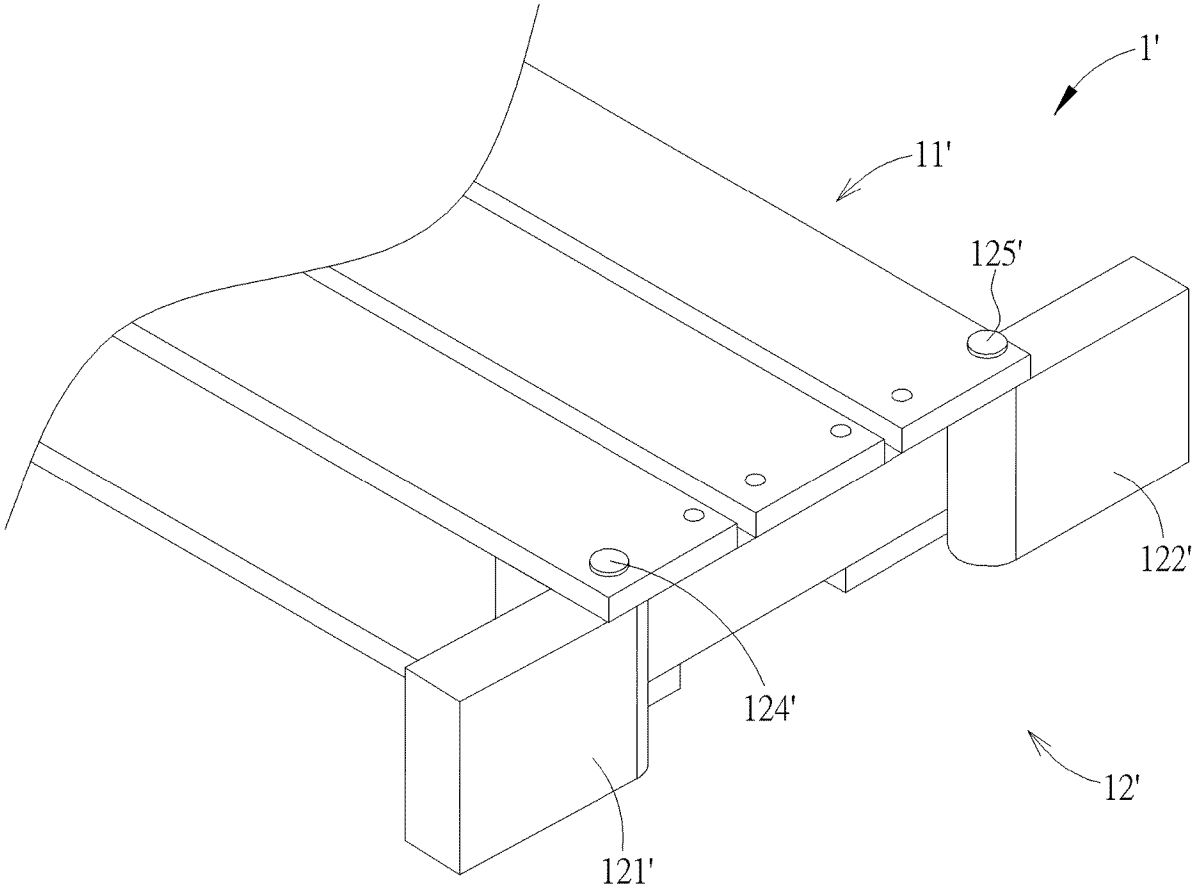
Figure 7:
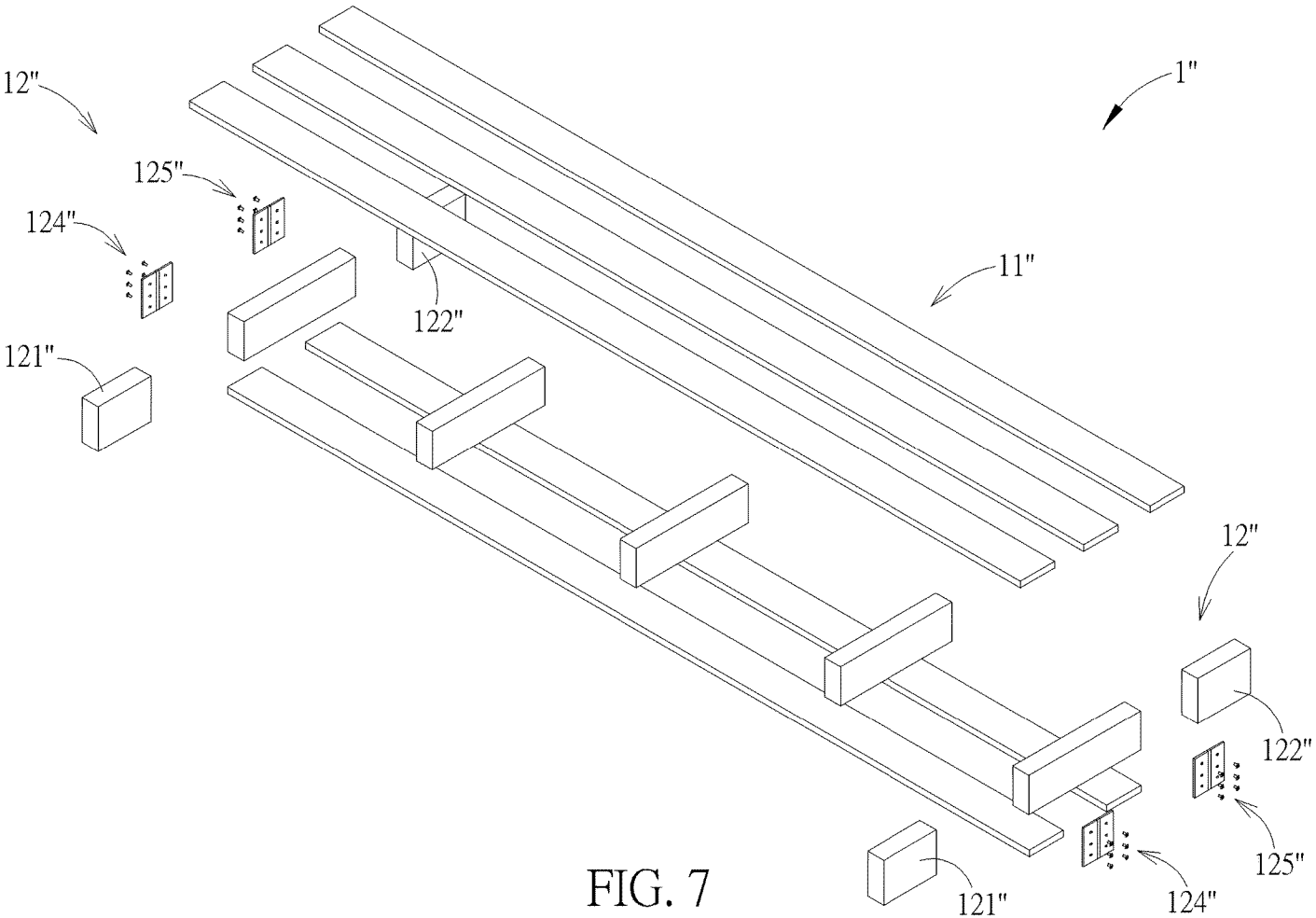
FIG. 7 is an exploded diagram of a pallet structure according to a third embodiment of the present disclosure.

However, the pallet structure of the present disclosure is not limited to the aforementioned embodiment. Description of the pallet structures of other embodiments are provided as follows. Please refer to FIG. 5 and FIG. 6. FIG. 5 and FIG. 6 are diagrams of a pallet structure 1' in different states according to a second embodiment of the present disclosure. As shown in FIG. 5 and FIG. 6, different from the pallet structure 1 of the first embodiment, the pallet structure 1' of the second embodiment includes a pallet body 11' and two supporting modules 12'. Each of the two supporting modules 12' includes a first supporting member 121', a second supporting member 122', a first pivoting member 124' and a second pivoting member 125'. The first supporting member 121' is pivotally connected to the pallet body 11' by the first pivoting member 124'. The second supporting member 122' is pivotally connected to the pallet body 11' by the second pivoting member 125'. In other words, the first supporting member 121' and the second supporting member 122' of the second embodiment can be foldable relative to the pallet body 11' in pivotal manners. Furthermore, in this embodiment, the first pivoting member 124' and the second pivoting member 125' can be two pivoting shafts. However, it is not limited thereto. Please refer to FIG. 7. FIG. 7 is an exploded diagram of a pallet structure 1" according to a third embodiment of the present disclosure. As shown in FIG. 7, the pallet structure 1" of the third embodiment includes a pallet body 11" and two supporting modules 12". Each of the two supporting modules 12" includes a first supporting member 121", a second supporting member 122", a first pivoting member 124" and a second pivoting member 125". The first pivoting member 124" and the second pivoting member 125" can be two hinges for pivotally connecting the first supporting member 121" and the pallet body 11" and pivotally connecting the second supporting member 121" and the pallet body 11" respectively.

Figure 8:
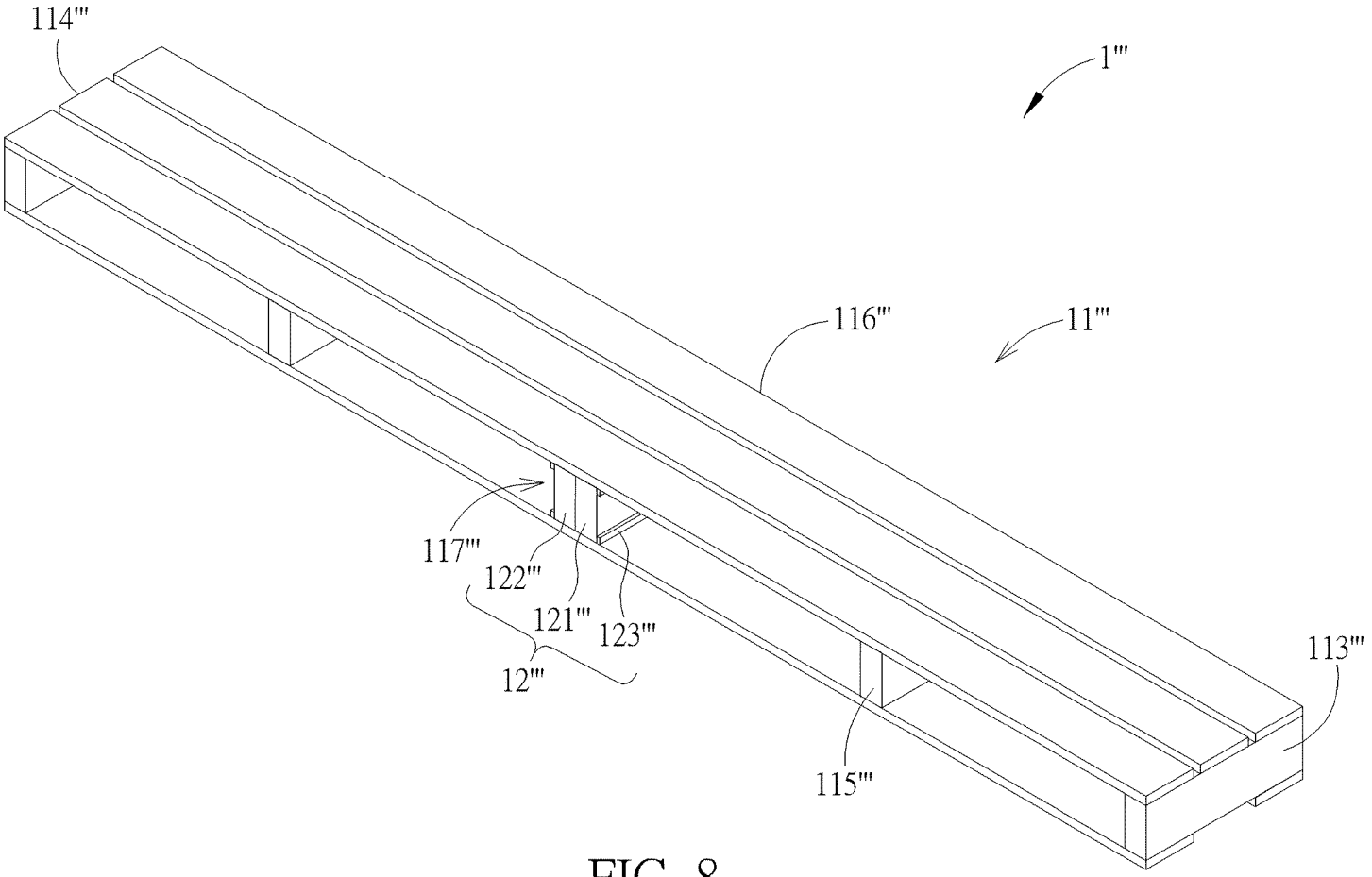
FIG. 8 and FIG. 9 are partial diagrams of a pallet structure in different states according to a fourth embodiment of the present disclosure.
Figure 9:
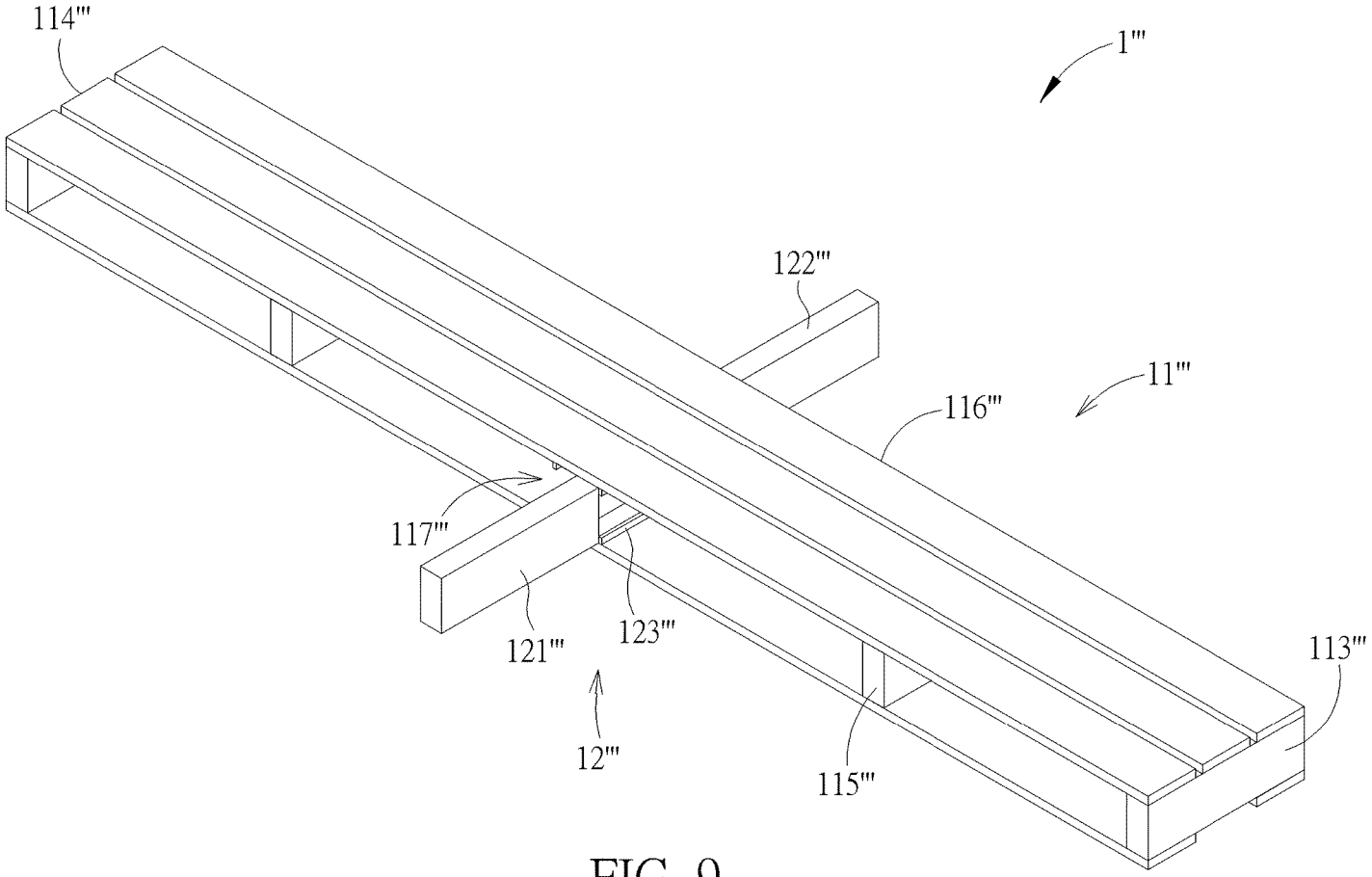
Figure 10:
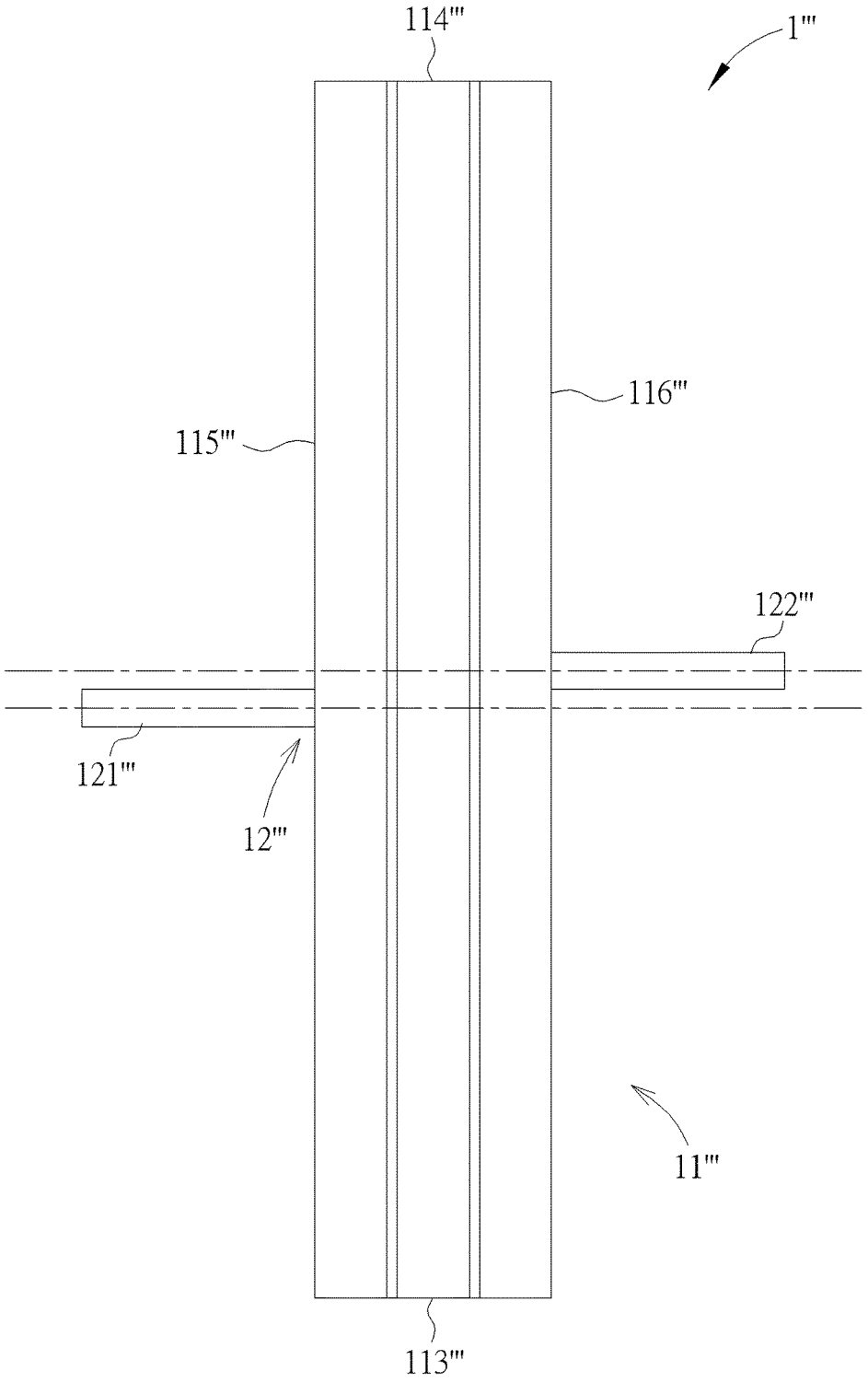
FIG. 10 is a top view diagram of the pallet structure shown in FIG. 9 according to the fourth embodiment of the present disclosure.
Figure 11:
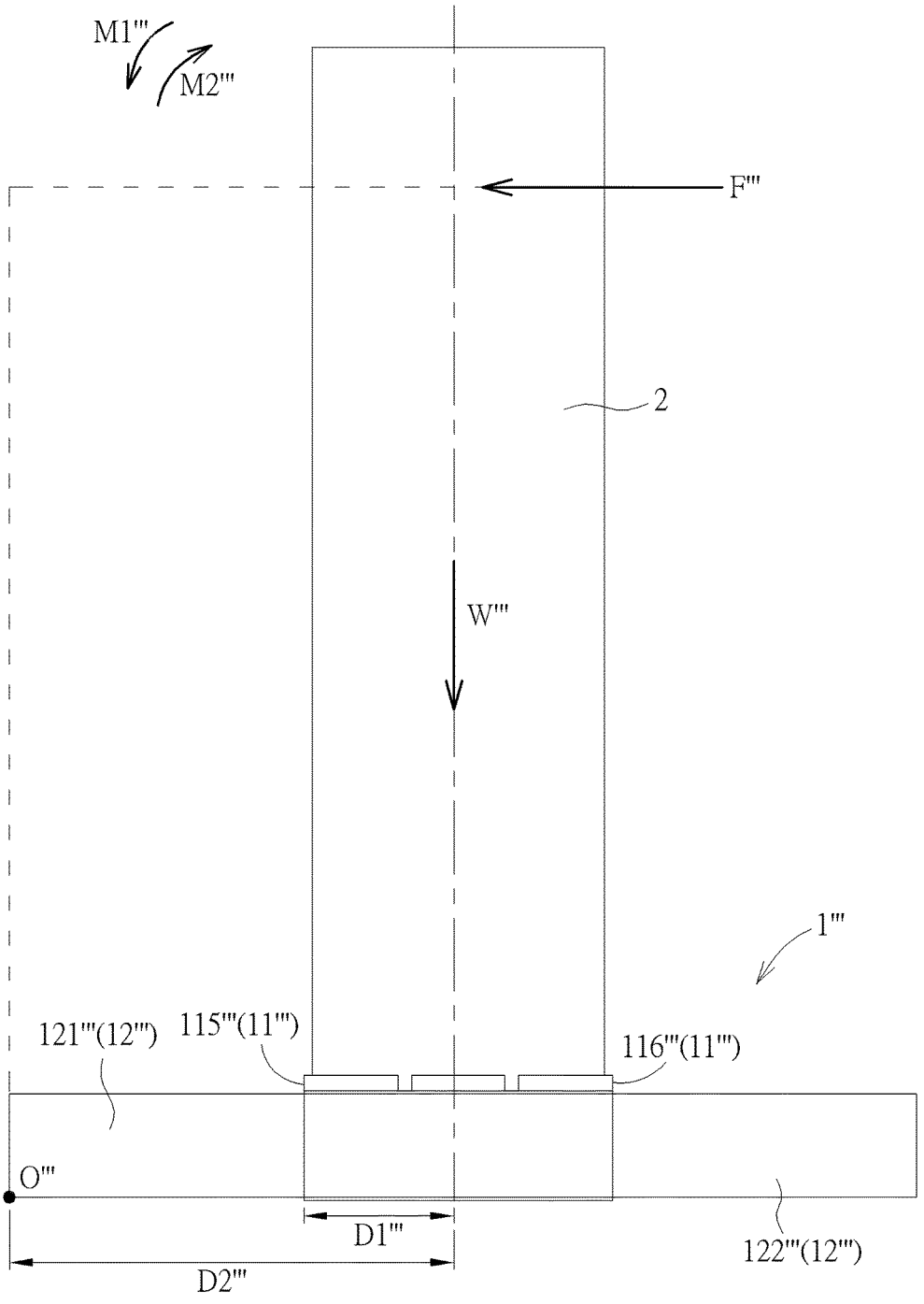
FIG. 11 is a free body diagram of the pallet structure shown in FIG. 9 according to the fourth embodiment of the present disclosure.

Furthermore, please refer to FIG. 8 to FIG. 11. FIG. 8 and FIG. 9 are partial diagrams of a pallet structure 1'" in different states according to a fourth embodiment of the present disclosure. FIG. 10 is a top view diagram of the pallet structure 1'" shown in FIG. 9 according to the fourth embodiment of the present disclosure. FIG. 11 is a free body diagram of the pallet structure 1'" shown in FIG. 9 according to the fourth embodiment of the present disclosure. As shown in FIG. 8 and FIG. 9, different from the pallet structure 1, 1', 1" of the aforementioned embodiments, the pallet structure 1' of the fourth embodiment include a pallet body 11'" and one supporting module 12'" only. There is only one chamber 117'" formed inside the pallet body 11'" for receiving the supporting module 12'" and located between the third side 113'" and the fourth side 114'" of the pallet body 11'". The supporting module 12'" includes a first supporting member 121'", a second supporting member 122'" and a sliding track 123'". The sliding track 123'" is disposed on a side wall of the chamber 117'", so that the first supporting member 121'" and the second supporting member 122'" can be folded or unfolded relative to the pallet body 11'" in sliding manners. Furthermore, in this embodiment, as shown in FIG. 10, the first supporting member 121'" and the second supporting member 122'" can be disposed in a parallel manner and not aligned on a line. A length of the first supporting member 121'" and a length of the second supporting member 122'" can be equal to a width of a lateral side of the pallet body 11'". Therefore, when the supporting module 12'" is folded relative to the pallet structure 11'" to a folded position, as shown in FIG. 8, the first supporting member 121'" and the second supporting member 122'" are overlapped with each other and folded inside the chamber 117'" and do not protrude from the fifth side 115'" and the sixth side 116'" of the pallet body 11'" respectively. On the other hand, when the supporting module 12'" is unfolded relative to the pallet structure 11" to an unfolded position, as shown in FIG. 9, the first supporting member 121'" and the second supporting member 122'" protrude from the fifth side 115'" and the sixth side 116'" of the pallet body 11'" respectively. As shown in FIG. 11, if the length of the first supporting member 121'" and the length of the second supporting member 122'" are substantially equal to the width of the lateral side 11'", a resistant moment arm D2'" provided by the supporting module 12'" is greater than a resistant moment arm D1'" only provided by a third side 113'" or a fourth side 114'" of the pallet body 11'", and the resistant moment arm D2'" is triple as long as the resistant moment arm D1'". Therefore, the first supporting member 121'" and the second supporting member 122'" can allow a weight W'" of the cargo 2 and the pallet structure 1'" to generate a moment M2'" which is large enough to overcome a moment M1'" generated by a lateral force F'" for preventing the cargo 2 and the pallet structure 1'" from falling over. However, it is not limited thereto. In another embodiment, the lengths of the first supporting member 121'" and the second supporting member 122'" can be less than the width of the lateral side of the pallet body 11'". In such a way, when the supporting module 12'" are folded relative to the pallet body 11'" to the folded position, the first supporting member 121'" and the second supporting member 122'" are partially overlapped with each other and folded in the chamber 117'" of the pallet structure 11'". It depends on practical demands.

In contrast to the prior art, in the present disclosure, when the cargo is placed on the pallet structure and stored in a warehouse, the supporting module can be operated to unfold relative to the pallet body to the unfolded position, i.e., the first position, so that the first supporting member and the second supporting member protrude from the pallet body. At this moment, the first supporting member and the second supporting member can provide a greater resistant moment arm for generating a larger resistant moment against a moment caused by an external lateral force acting on the cargo. Therefore, the present disclosure can effectively prevent the cargo and the pallet structure from falling over. On the other hand, when the cargo and the pallet structure are loaded into a container for transportation, the supporting module can be operated to fold relative to the pallet body to the folded position, i.e., the second position, so that the first supporting member and the second supporting member are folded inside the chamber and does not protrude from the pallet body. At this moment, the cargo and the pallet structures can be closely arranged adjacent to other cargos and other pallet structures respectively. Therefore, it can effectively increase usage rate of a loading space of the container, which reduces transportation cost and prevents damage of the cargos caused by collision during transportation.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An anti-dumpling pallet structure comprising:

a pallet body, a chamber being formed inside the pallet body; and at least one supporting module switchable between a first position and a second position relative to the pallet body, the at least one supporting module comprising a first supporting member and a second supporting member, the first supporting member and the second supporting member being movably connected to the pallet body, the first supporting member and the second supporting member protruding from the pallet body to provide support for preventing the pallet body acted by an external force from falling over when the at least one supporting module is located at the first position relative to the pallet body, and the first supporting member and the second supporting member being received inside the chamber when the at least one supporting module is located at the second position relative to the pallet body.

2. The pallet structure of claim 1, wherein the at least one supporting module further comprises a sliding track disposed on the pallet body, and the first supporting member and the second supporting member are slidably disposed on the sliding track.

3. The pallet structure of claim 2, wherein the sliding track comprises a first stopping portion and a second stopping portion, and the first stopping portion and the second stopping portion stop the first supporting member and the second supporting member respectively when the at least one supporting module is located at the first position relative to the pallet body.

4. The pallet structure of claim 1, wherein the at least one supporting module further comprises a first pivoting member and a second pivoting member, the first supporting member is pivotally connected to the pallet body by the first pivoting member, and the second supporting member is pivotally connected to the pallet body by the second pivoting member.

5. The pallet structure of claim 4, wherein the first pivoting member and the second pivoting member are pivoting shafts.

6. The pallet structure of claim 4, wherein the first pivoting member and the second pivoting member are hinges.

7. The pallet structure of claim 1, wherein the first supporting member and the second supporting member are parallel to each other when the at least one supporting module is located at the first position relative to the pallet body.

8. The pallet structure of claim 7, wherein a sum of a length of the first supporting member and a length of the second supporting member is substantially equal to or less than a width of a lateral side of the pallet body.

9. The pallet structure of claim 7, wherein a length of the first supporting member and a length of the second supporting member are substantially equal to a half of a width of a lateral side of the pallet body.

10. The pallet structure of claim 7, wherein the first supporting member and the second supporting member are aligned on a line when the at least one supporting module is located at the first position relative to the pallet body.

11. The pallet structure of claim 1, wherein the first supporting member and the second supporting member are at least partially overlapped with each other and received inside the chamber when the at least one supporting module is located at the second position relative to the pallet body, and the first supporting member and the second supporting member are parallel to each other when the at least one supporting module is located at the first position relative to the pallet body.

12. The pallet structure of claim 11, wherein a sum of a length of the first supporting member and a length of the second supporting member is substantially greater than a width of a lateral side of the pallet body.

13. The pallet structure of claim 11, wherein a length of the first supporting member and a length of the second supporting member are substantially equal to a width of a lateral side of the pallet body.

14. The pallet structure of claim 11, wherein the first supporting member and the second supporting member are not aligned on a line when the at least one supporting module is located at the first position relative to the pallet body.

15. The pallet structure of claim 1, wherein the pallet structure comprises a first side, a second side, a third side, a fourth side, a fifth side and a sixth side, the first side is for supporting an object, the second side is opposite to the first side and for contacting a supporting surface, the third side and the fourth side are opposite to each other and adjacent to the first side and the second side, the fifth side and the sixth side are opposite to each other and adjacent to the first side, the second side, the third side and the fourth side, a length of the fifth side and a length of the sixth side are greater than a length of the third side and a length of the fourth side, and the at least one supporting module is disposed on at least one of the third side and the fourth side.

16. The pallet structure of claim 15, comprising two supporting modules disposed on the third side and the fourth side respectively.

17. The pallet structure of claim 15, wherein the first supporting member and the second supporting member protrude from the fifth side and the sixth side of the pallet body respectively when the at least one supporting module is located at the first position relative to the pallet body.

18. The pallet structure of claim 15, wherein the first supporting member and the second supporting member do not protrude from the fifth side and the sixth side of the pallet body respectively when the at least one supporting module is located at the second position relative to the pallet body.

19. The pallet structure of claim 1, wherein the first position is an unfolded position, the second position is a folded position, the first supporting member and the second supporting member are received inside the chamber and do not protrude from the pallet body when the at least one supporting module is located at the folded position relative to the pallet body.

20. The pallet structure of claim 1, wherein the pallet structure is adapted for carrying a cargo, a height of the cargo is substantially greater than or equal to a height of the pallet structure, and the cargo is a cabinet, a server rack, or a display device.

* * * * *